United States Patent [19]

Vidas

[11] Patent Number: 4,585,259

[45] Date of Patent: Apr. 29, 1986

[54] PORTABLE DOOR LOCKING DEVICE

[76] Inventor: Aaron L. Vidas, 461 Ann St., West Chicago, Ill. 60185

[21] Appl. No.: 673,927

[22] Filed: Nov. 21, 1984

[51] Int. Cl.[4] ..... E05C 17/54

[52] U.S. Cl. ..... 292/339; 292/DIG. 15; 292/244

[58] Field of Search ..... 292/339, 343, 258, 288, 292/293, 244, DIG. 15

[56] References Cited

U.S. PATENT DOCUMENTS 4,198,088 4/1980 Tochihara ..... 292/DIG. 15

*Primary Examiner*—Richard E. Moore

*Attorney, Agent, or Firm*—Douglas B. White

[57] ABSTRACT

There is provided herein a portable door locking device for securing a door which consists of a base member having an abutment member adapted to abut one side of the door and supporting proximate thereto a tab arranged to engage the vertical door edge to prevent lateral movement of the device. The base member is arranged to extend beyond the door and door frame when the door is in a closed position and supports on its extremity a locking crossbar arranged to engage the door frame. For a second mode of operation, there is provided a floor engaging device having a screw clamp arranged to secure the device to the door and to lower a serrated foot member to engage the floor.

5 Claims, 8 Drawing Figures

PORTABLE DOOR LOCKING DEVICE

BACKGROUND OF THE INVENTION

The present invention relates generally to door locking mechanisms and more particularly to portable devices for attachment at the edge of a door to secure the door against movement when in a closed position.

Prior devices have generally required modification of the door jamb and are therefore inappropriate for use by travellers or for use in apartments where the landlord objects to the modification of the door jamb. An example of such a prior device is described in the patent issued to Sessions, U.S. Pat. No. 4,330,146. With the Sessions device, a bracket placed under the door is engaged with a hole drilled into the door frame.

Recent devices which require no modification to the door jamb are represented by U.S. Pat. No. 3,181,319 issued to Hudon which uses a bar having a key member on one end thereof and is secured at its other end with a padlock. The device is extended through the opening between the closed door and the frame. This device, however, is not useful unless a straight gap is provided between the door and the frame, and the thickness of the locking member must be quite thin. Another device employed for locking the door from the inside of a room is represented by U.S. Pat. No. 4,198,088, issued to Tochihara. There a floor engaging device is described which clamps to the bottom of a door and which is adjustable in a downward direction to grip the floorcovering.

SUMMARY OF THE INVENTION

Accordingly, it is a principal object of the present invention to provide a portable lock for use by travellers which will secure a door such as a hotel room door from either the inside or the outside without necessitating modifications to the door structure. Generally there is provided a door locking device for securing a door to a door frame which comprises a base member having an abutment member adapted to abut one side of the door with said base member arranged to extend beyond the door and door frame when the door is in a closed position. On the protruding end thereof there is provided a locking crossbar pinned for pivotal motion and arranged to engage the door frame. To prevent lateral movement a tab member is provided to engage the vertical door edge. In an additional feature, there is further provided a floor engaging device comprising a screw clamp to secure the device to the door and to simultaneously lower a serrated foot member to engage the floor.

Other objects and advantages of the invention will become apparent upon reading the following detailed description and upon reference to the drawings, in which.

While the invention will be described in connection with the preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENT

Figure 1:
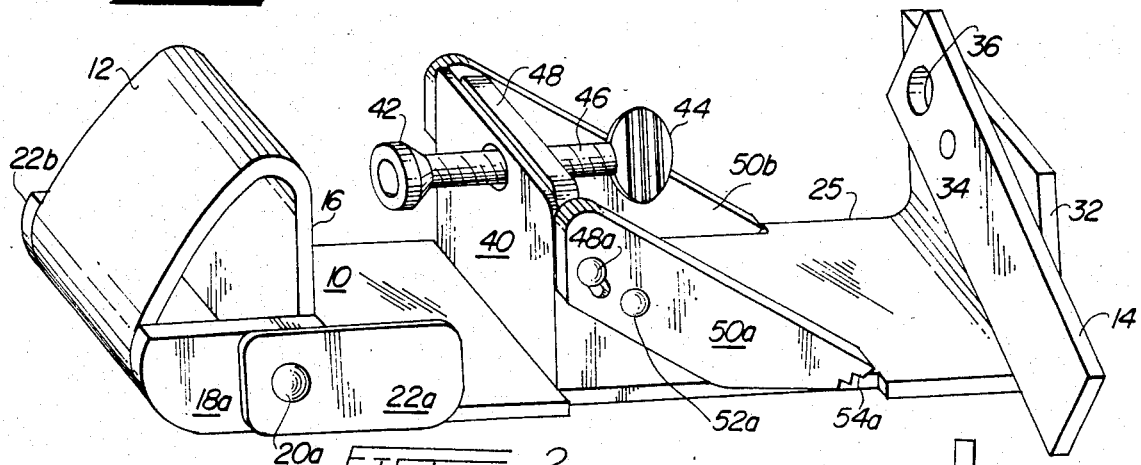
FIG. 1 is a pictorial view of the preferred embodiment of the present invention.

Turning first to FIG. 1 there is shown a door lock assembly consisting of a base member 10 having a door abutting member 12 affixed at a first end thereof and a door frame engaging member 14 mounted on the opposite end thereof. The door abutting member may be formed by extending the base member and bending same in a triangular shape to form the abutting face 16 for placement against the door. Providing structural support to this door abutment member are closure members **18*a* and 18*b* rigidly affixed to the sides thereof. Attached to the support member 18 at a pivotal connection 20 there is shown a tab 22*a*** arranged to selectively engage the vertical edge of the door.

Figure 2:
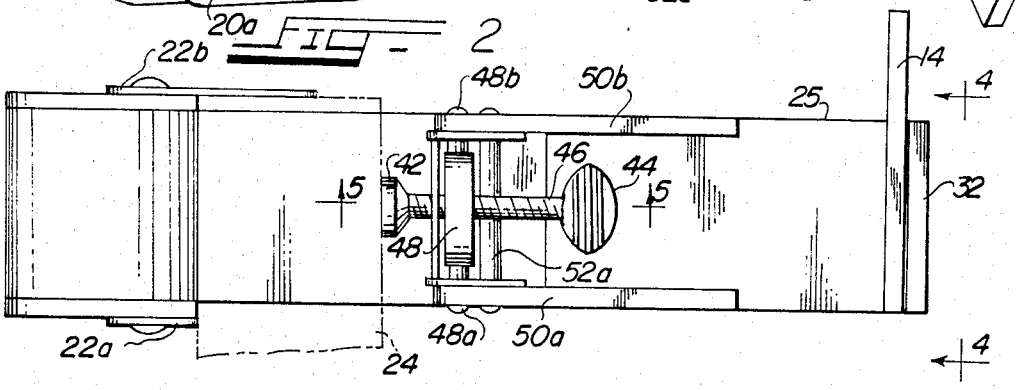
FIG. 2 is a plan view of the device of FIG. 1.

Turning now to FIG. 2, the locking device of FIG. 1 is shown positioned on the edge of a door member indicated generally by the numeral 24. In this position the tab **22*a* is shown in a vertically aligned position so as not to contact the door 24, while the opposite tab 22*b* is shown pivoted to a horizontal position to abut the vertical edge of the door 24**.

Figure 8:
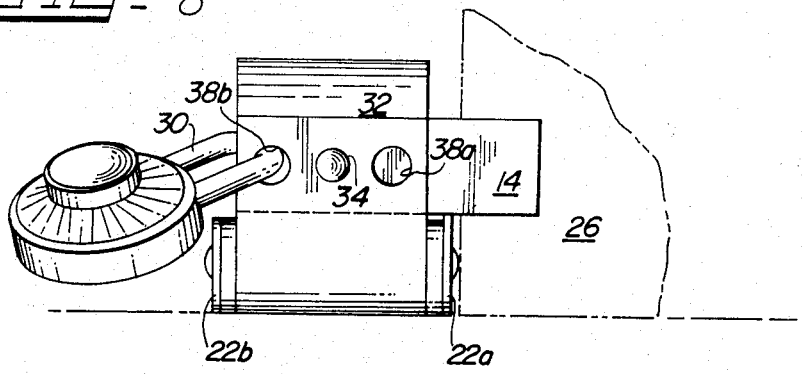
FIG. 8 is an end view of the locked device of FIG. 6.

The protruding extension 25 of the base member 10 extends beyond the door frame 26 (FIG. 8) whereupon the latch member 14 is secured against the door frame and locked in place by a locking mechanism 30. This latch plate 14 is pivotally affixed at the pinned connection 34 to the upwardly extending portion 32 of the base member. An opening 36 in the latch member is provided proximate the pivot and arranged to align with corresponding openings **38*a* and 38*b* in the upward extending member 32**.

In operation, to secure a door opening away from the operator, the extension portion 25 of the base is placed under the door with the abutting surface 16 of the abutment member 12 against the door 24. The device is then prevented from lateral movement along the door by placement of the tab **22*a* or 22*b* along the vertical edge of the door. The latching plate 14 is then pivoted to catch against the door frame 26 and is secured in place by a lock 30 through hole 36 in the latch member and hole 38 in the upward extending member 32**.

Figure 3:
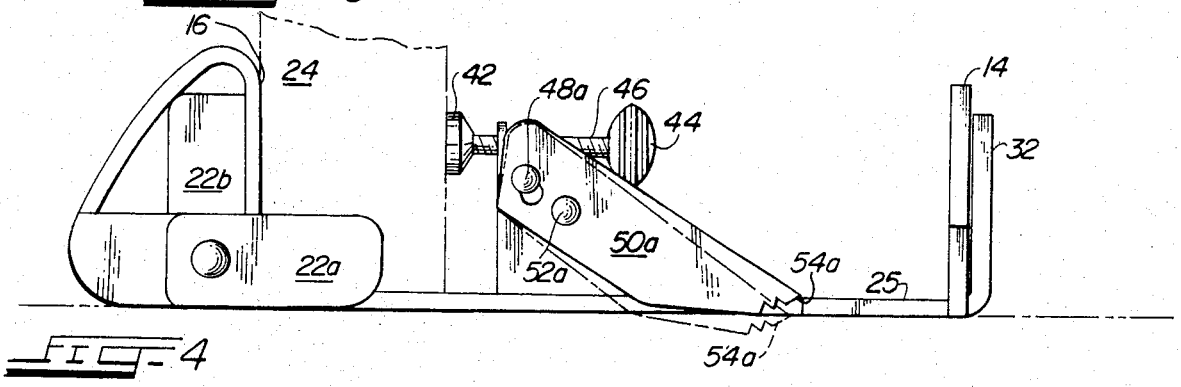
FIG. 3 is a side view of the device of FIG. 1 engaging a door in locking position.
Figure 4:
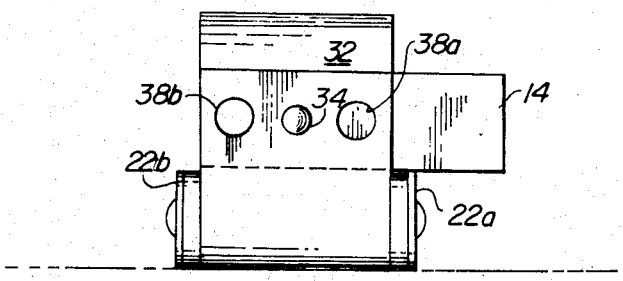
FIG. 4 is an end view of the device of FIG. 1.
Figure 5:
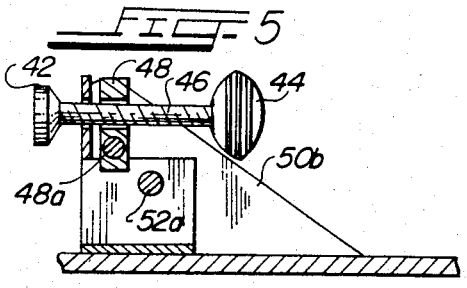
FIG. 5 is a cross-sectional view of the middle section of the device of FIG. 1.
Figure 6:
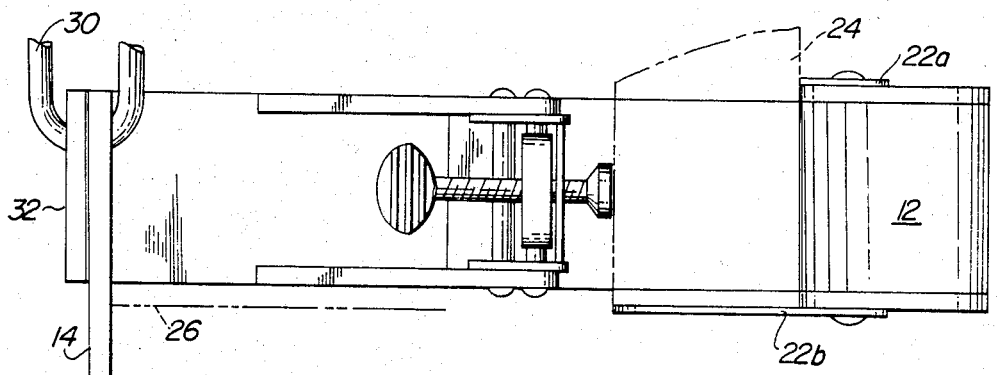
FIG. 6 is a plan view of the device of FIG. 1 engaging a door and door frame in locking position.
Figure 7:
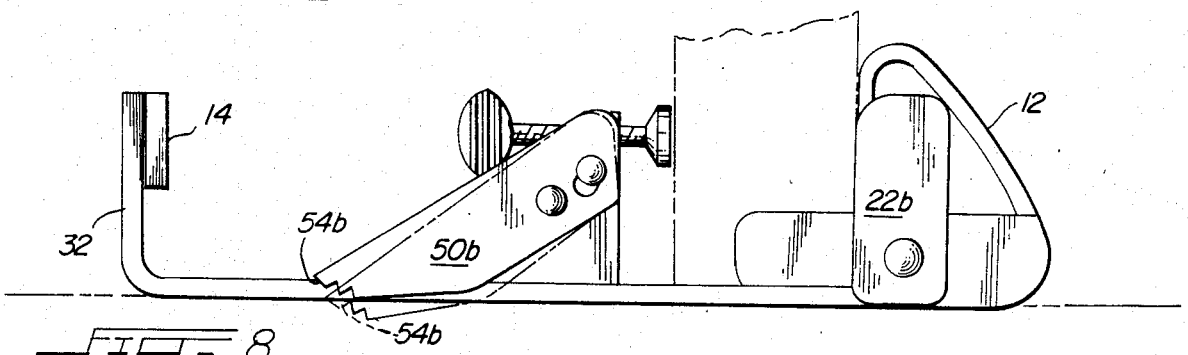
FIG. 7 is side view of the device of FIG. 1 engaging a door in locking position in a second mode of operation.

To secure a door which opens towards the operator, the center portion of the device is brought into play. This portion is comprised of an upright support member 40 rigidly attached to the base 10 and supporting a stopper 42 which is provided with a thumbscrew handle 44 and a threaded portion 46 to be advanced through the support member and against the door 24 (see FIG. 3 and FIG. 8). Upon contact of the stopper 42 against the door, the travelling lever member 48 travels along the threaded portion, away from the door, and causes a lateral force to be applied at its extremities **48*a* and 48*b*. Attached to these extremities are foot members 50*a* and 50*b* arranged to pivot around points 52*a* and 52*b* respectively. Upon occurrence of the lateral forces from the travelling member, the foot members are caused to rotate and the serrated bottom portion 54** of the foot member is therefore caused to come into contact with the floor to secure the device in position. To remove the locking device, the thumbscrew is counter-rotated to pull the travelling member forward toward the door. This pivots the foot members, raising the serrated portion away from the floor and, at the same time, unclamping the device from the door.

In summary, there has been shown a door locking device for securing a door to a door frame which comprises a base member having an abutment member adapted to abut one side of the door and prevented from lateral movement along the door by tab members. The base extends beyond the door and door frame and supports a locking crossbar pinned for pivotal motion and positioned to engage the door frame. For a second mode of operation, there is provided a floor engaging device comprising a screw clamp to secure the device to the door and arranged to lower a serrated foot member to engage the floor.

I claim:

1. A device for locking a door to a door frame comprising:

a. an elongated base member arranged to extend under the door having a first and second extremity wherein said first extremity is arranged to extend beyond the door frame when the door is in a closed position;

b. a locking member mounted to said first extremity of said base member and arranged to be selectively positioned to extend transversely beyond said base member to thereby engage the door frame;

c. means for securing said locking member in said selected position;

d. an abutment member mounted to said second extremity of said base member, affixed in substantially perpendicular relation to said base member and positioned to abut the door; and e. a first tab member pivotally mounted to said base member proximate said abutment member and arranged for selective engagement with the vertical door edge to prevent horizontal movement of the locking device.

2. The device of claim 1 further comprising a second tab member pivotally mounted to said base member opposite said first tab for selective engagement with a vertical door edge.

3. The device of claim 1 further comprising:

a. clamping means for securing the door locking device to the door, b. floor-engageing members pivotally mounted to said base; and c. means for selectively pivoting said floor-engaging members into contact with the floor.

4. The device of claim 3 wherein said means for selectively pivoting said floor-engaging members is integral with said clamping means.

5. The device of claim 4 further comprising a second tab member pivotally mounted to said base member opposite said first tab member for selective engagement with a vertical door edge.

* * * * *